US007237583B2

(12) United States Patent
Salani et al.

(10) Patent No.: US 7,237,583 B2
(45) **Date of Patent: *Jul. 3, 2007**

(54) MULTIPURPOSE COLLAPSIBLE FUNNEL

(75) Inventors: Theodore R. Salani, Woodridge, IL (US); Lawrence A. Salani, Palatine, IL (US)

(73) Assignee: S & S Concepts, Inc., Elk Grove Village, IL (US)

( * ) Notice: Subject to any disclaimer, the term of this patent is extended or adjusted under 35 U.S.C. 154(b) by 259 days.

This patent is subject to a terminal disclaimer.

(21) Appl. No.: 10/480,672

(22) PCT Filed: Jun. 12, 2002

(86) PCT No.: PCT/US02/18984

§ 371 (c)(1),
(2), (4) Date: Aug. 3, 2004

(87) PCT Pub. No.: WO02/100764

PCT Pub. Date: Dec. 19, 2002

(65) Prior Publication Data

US 2004/0256027 A1 Dec. 23, 2004

Related U.S. Application Data

(60) Provisional application No. 60/327,021, filed on Oct. 4, 2001, provisional application No. 60/297,545, filed on Jun. 12, 2001.

(51) Int. Cl.
*B65B 1/04* (2006.01)

(52) U.S. Cl. ..... 141/337

(58) Field of Classification Search ..... 141/331, 141/337, 338
See application file for complete search history.

(56) References Cited

U.S. PATENT DOCUMENTS

| | | | | |
|---|---|---|---|---|
| 2,100,888 | A * | 11/1937 | Vine | 141/337 |
| 4,108,222 | A | 8/1978 | Kaufman | |
| 4,158,631 | A * | 6/1979 | Whelan | 210/497.1 |
| 4,239,130 | A | 12/1980 | Altadonna | |
| 4,308,986 | A * | 1/1982 | Parrilli | 206/470 |

(Continued)

FOREIGN PATENT DOCUMENTS

| | | |
|---|---|---|
| DE | 674079 | 4/1939 |

(Continued)

OTHER PUBLICATIONS

About In Flight USA, In Flight USA On-Line, Feb. 19, 2003, http://www.inflightusa.com/s.info.shtml.

(Continued)

*Primary Examiner*—Steven O. Douglas
(74) *Attorney, Agent, or Firm*—Katten Muchin Rosenman LLP; John S. Paniaguas

(57) ABSTRACT

A collapsible funnel may be removably secured to a container, label or provided independently. In another aspect of the invention, a business method is disclosed in which a funnel blank or collapsed funnel is used as a substrate for printed indicia and incorporated into or used as a printed publication, such as a sports program, catalog or advertisement and formed as a funnel. Lastly, a funnel blank is provided with optional perforations and for printed indicia which enable an end user to vary the size of the funnel nozzle.

12 Claims, 11 Drawing Sheets

U.S. PATENT DOCUMENTS

| | | | | |
|---|---|---|---|---|
| 5,004,353 | A * | 4/1991 | Martin | 366/349 |
| 5,033,521 | A | 7/1991 | Martin | |
| 5,060,130 | A | 10/1991 | Steigerwald | |
| 5,060,849 | A | 10/1991 | King | |
| 5,078,189 | A | 1/1992 | Ronsonet | |
| 5,101,870 | A | 4/1992 | Farris | |
| 5,104,012 | A | 4/1992 | McAllister et al. | |
| 5,601,230 | A * | 2/1997 | Bell | 229/103 |
| 5,988,373 | A * | 11/1999 | Yates | 206/296 |
| 6,112,949 | A | 9/2000 | Rhodes et al. | |
| 6,154,891 | A * | 12/2000 | Wilson | 4/144.4 |
| 6,202,225 | B1 * | 3/2001 | Beck et al. | 4/144.2 |

FOREIGN PATENT DOCUMENTS

| | | | |
|---|---|---|---|
| DE | 8908225 | | 1/1990 |
| DE | 8908225 | U1 | 1/1990 |
| FR | 2420507 | A1 | 3/1978 |
| FR | 2565956 | A1 | 6/1984 |
| FR | 2621979 | A1 | 4/1989 |
| FR | 2497786 | A1 | 7/1992 |
| FR | 2704205 | A1 | 10/1994 |
| WO | WO 96/10533 | A1 | 4/1996 |

OTHER PUBLICATIONS

Disposable Funnel Ideal When Adding Oil to Vehicles And Industrial Equipment, Feb. 11, 2003, http://www/tormfgco.com/MAGAZINEWRITEUPS.html.

Disposable Funnel Ideal When Adding Oil To Vehicles And Industrial Equipment, Feb. 7, 2003, http://www/tormfgco.com.

Disposable Funnel Ideal When Adding Oil to Vehicles And Industrial Equipment, Feb. 7, 2003, http://www/tormfgco.com/WHERETOBUY.html *.

Both Sides of Funnel Available from Basler Flight Service.

Disposable Oil Funnel (10 Pack), Feb. 5, 2003, http://shopping.pilotportal.com/catalog/product.html?productid+2572&categoryid=217.

International Search Report, Dec. 26, 2002.

Supplementary European Search Report, Apr. 7, 2006.

* cited by examiner

MULTIPURPOSE COLLAPSIBLE FUNNEL

CROSS-REFERENCE TO RELATED APPLICATIONS

This application is the national phase application under 35 USC §371 of International Application No. PCT/US02/18984, filed on Jun. 12, 2002, which claims priority and the benefit of U.S. Provisional Patent Application No. 60/297,545, filed on Jun. 12, 2001 and U.S. Provisional Application No. 60/327,021, filed on Oct. 4, 2001.

BACKGROUND OF THE INVENTION

1. Field of the Invention

The present invention relates to a collapsible funnel and more particularly to a funnel packaged in a collapsed form and adapted to be quickly and easily expanded into a funnel with a fluid inlet opening on one end and a fluid outlet opening on an opposing end, the funnel being provided with optional perforations and/or printed indicia for facilitating selection of the fluid outlet size, and a business method of using a funnel blank or a collapsed funnel as a substrate for printed indicia and used as or incorporated into a printed publication, such as a sports program, catalog or advertisement.

2. Description of the Prior Art

Various funnel systems are known for use with various fluids. A common application of such funnel systems relates to the use of various fluids in various vehicles including automobiles. For example, motor oil is normally provided in a sealed can or a container with a screw off cap. Such motor oil is sold in most retail distribution markets as well as in various service stations. In order to avoid spilling the oil all over the engine, normally a re-usable funnel is used and inserted into the oil receiving receptacle of the engine. In many applications, such funnels are not readily available and as such consumers who purchase oil in service stations take the chance of spilling oil on various engine parts while attempting to pour the engine oil into the engine oil receiving receptacle on their automobile engine.

In order to resolve this problem, various systems have been developed, for example, as disclosed in U.S. Pat. Nos. 5,101,870; 5,104,012; 5,033,521; 4,239,130; 6,112,949; 5,060,849; 5,601,230 and French Patent No. 2 565 956. In particular, U.S. Pat. No. 5,104,012 discloses a container with a flexible tube removably attached to the exterior of the container in a flattened position that is adapted to be attached to a spout on a container to form a dispenser for dispensing the fluid within the container. U.S. Pat. No. 6,112,949 discloses a container with an extendable bellows-like tube disposed within the container that is adapted to be pulled out when the cap is removed to form a dispenser for the fluid within the container. U.S. Pat. No. 5,033,521 discloses an oil cap for sealing the inlet port of an oil receiving receptacle on an automobile. The cap is configured with a collapsible funnel. U.S. Pat. No. 5,101,870 discloses a fluid container with a disposable funnel formed to the contour of an upper portion of the container and adapted to fit over the top outside of the container and be secured thereto by way of the cap. With such a configuration, when the cap is removed, the disposable funnel is inverted and inserted into the oil receiving receptacle to enable the fluid within the container to be poured into the oil receiving receptacle without making a mess. U.S. Pat. No. 4,239,130 discloses an oil caddy adapted to be secured in a trunk of an automobile or other vehicle which includes a canister for holding an oil can and a funnel attached to the upper portion of the canister. The funnel in this embodiment is not disposable. French Patent No. 2 565 956 discloses a collapsible funnel system formed from a number of concentric rings which are configured such that in an expanded configuration, the concentric rings form a funnel. The patents disclosed above all disclose various types of funnels for use with various fluids. Unfortunately, all of these systems are rather complicated and thus expensive which explains why none of these systems are in widespread use.

Other funnel-type systems are known which are less expensive to produce. For example, U.S. Pat. No. 5,060,849 discloses a carton for carrying, for example, a case of oil containers. The carton is provided with various die cuts which enable the carton to be folded in two different configurations thus providing a dual purpose carton. In one configuration, the carton may be folded into a box for simply carrying various fluid containers. In the alternate configuration, the carton can be refolded into a funnel to facilitate pouring of the fluid content within one of the containers. U.S. Pat. No. 5,601,230 discloses another less expensive type funnel system. In particular, the '230 patent discloses a box for carrying multiple fluid containers. The lid of the box is die cut and preformed with fold lines which are prestamped to enable a portion of the lid to be removed from the top of the box and folded into a funnel. The problem with the systems disclosed in the '849 and '230 is that these patents disclose a funnel system in which a single disposable funnel is provided for a multiple number of fluid containers. Unfortunately, with such a design it is very likely that once the funnel is formed and used once it will likely be discarded and not available for use for the remaining fluid containers. Thus, there is a need for a collapsible funnel for use with a fluid container which will likely be available for use with each individual fluid container.

SUMMARY OF THE INVENTION

The present invention relates to a collapsible funnel. In accordance with an important aspect of the invention, the collapsible funnel may be removably secured to a container, label etc. or provided independently. In another aspect of the invention, a business method is disclosed in which a funnel blank or collapsed funnel is used as a substrate for printed indicia and incorporated into or used as a printed publication, such as a sports program, catalog or advertisement and formed as a funnel. Lastly, a funnel is provided with optional perforations and printed indicia which enable an end user to vary the size of the funnel fluid outlet opening.

DESCRIPTION OF THE DRAWINGS

These and other advantages of the present invention will be readily understood with reference to the following specification and attached drawing wherein:

FIGS. 14A, 15A and 16A are alternate embodiments of funnels in accordance with the present invention shown in collapsed form while

DETAILED DESCRIPTION

Figure 11A:
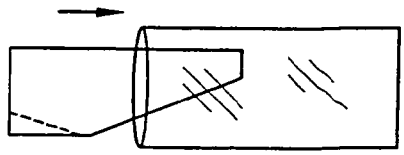
FIGS. 11A and 11B illustrate a package for the collapsible funnel in accordance with the present invention.
Figure 11B:
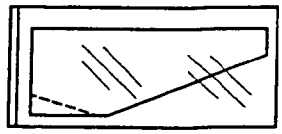
Figure 12A:
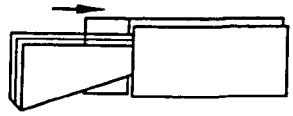
FIGS. 12A and 12B illustrate an alternate package for the funnels in accordance with the present invention.
Figure 12B:
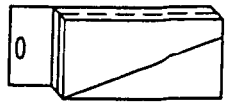
Figure 13A:
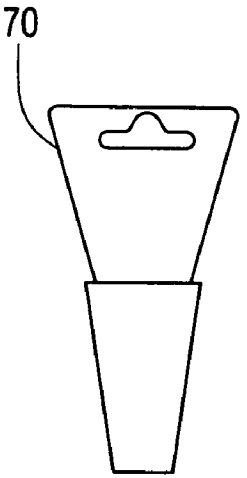
FIGS. 13A-13G illustrate alternate header cards for use with the present invention.
Figure 13B:
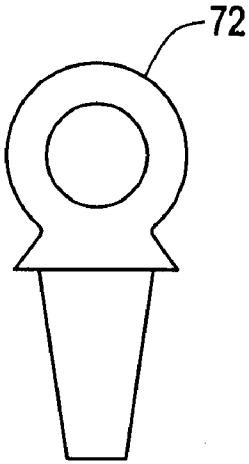
Figure 13C:
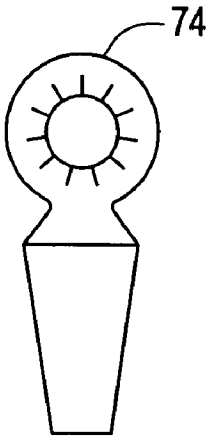
Figure 13D:
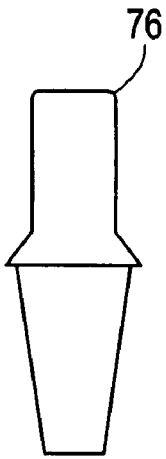
Figure 13E:
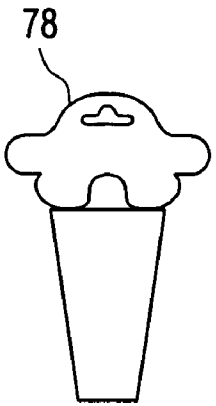
Figure 13F:
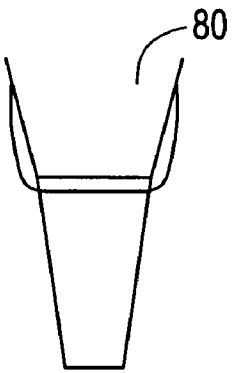
Figure 13G:
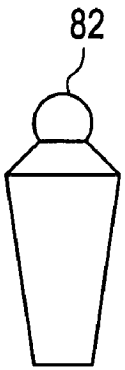
Figure 14A:
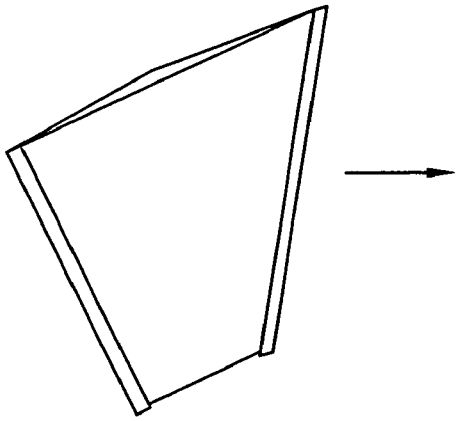
Figure 14B:
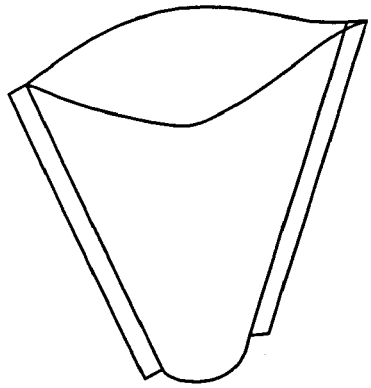
FIGS. 14B, 15B and 16B illustrate these funnels in expanded form.
Figure 15A:
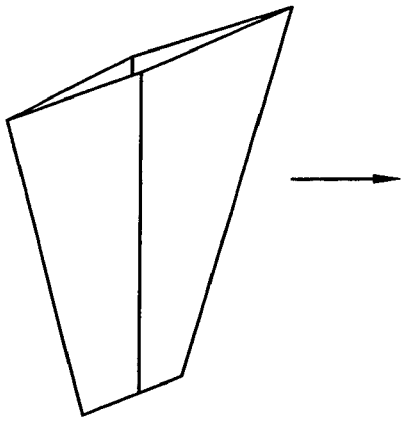
Figure 15B:
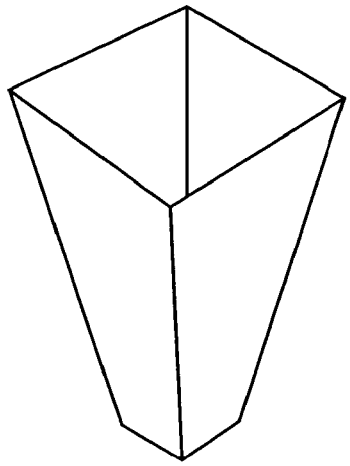
Figure 16A:
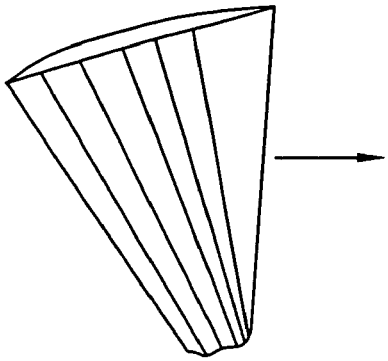
Figure 16B:
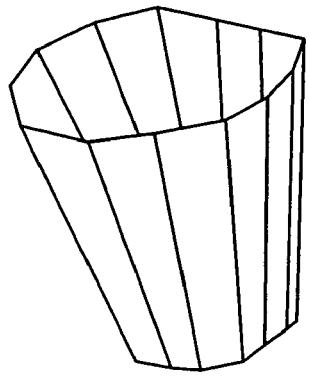

Various embodiments of the invention are contemplated. For example FIGS. 1-6, and 14-16 relate to a collapsible funnel in accordance with the present invention while FIGS. 7-10, 17 and 18 illustrate a process for making disposable funnels having different configurations. FIGS. 11-12 illustrate various package configurations for packaging a disposable funnel in accordance with the present invention. FIGS. 14-16 illustrate various embodiments of a funnel with different configurations of a header card in accordance with the present invention. FIG. 19 illustrates a funnel blank with optional perforation lines and/or printed indicia which allows the diameter of the funnel nozzle to be selected by the user. Lastly, a business method is disclosed in which a funnel blank or collapsed funnel is printed with indicia, such as sports data or advertising indicia and used as a printed publication or inserted into a printed publication which can be easily formed into or expanded funnel. All of the various aspects of the present invention are considered to be within the broad scope of the present invention.

Collapsible Funnel

Figure 1:
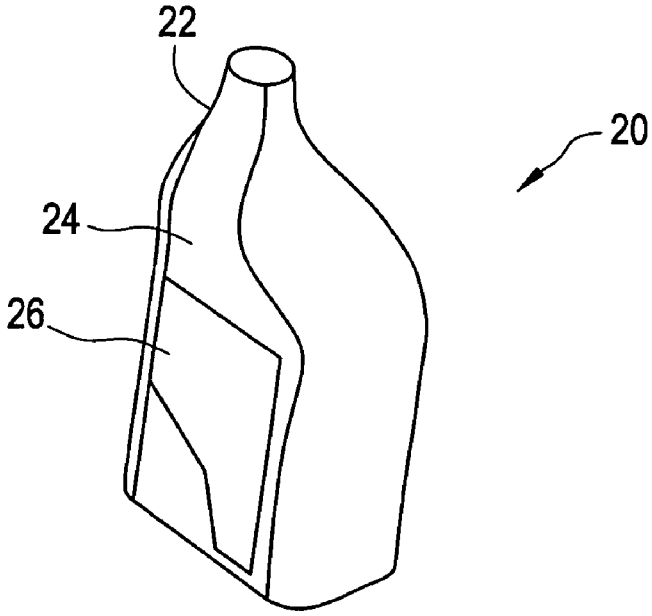
FIG. 1 is perspective view of a collapsible funnel in accordance with the present invention removably attached to a container in accordance with the present invention.
Figure 5:
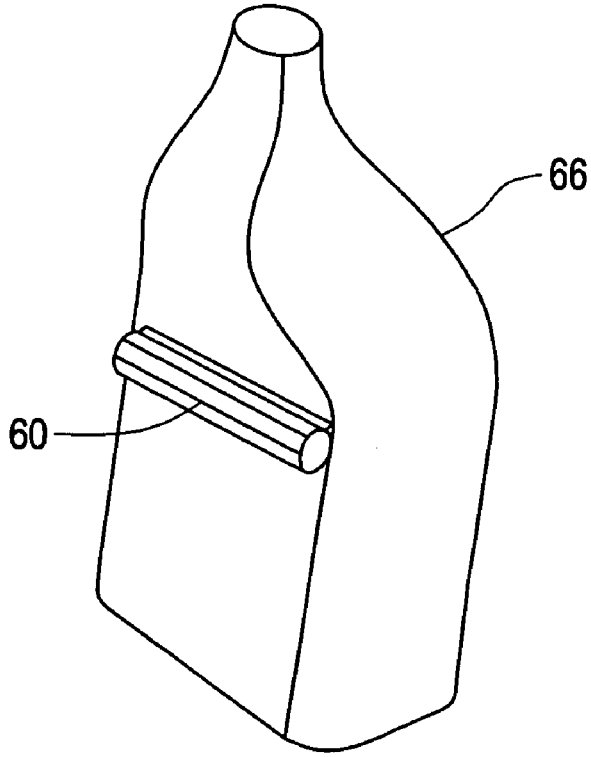
FIG. 5 is a perspective view of another alternate embodiment of the invention in which the funnel is shown in a rolled configuration and attached to a container.

The present invention in one embodiment relates to a collapsible funnel that in one embodiment is adapted to be releasably secured to a container or a label. The collapsible funnel in accordance with the present invention is relatively simple and inexpensive and enables the funnel to be provided with each individual container as illustrated in FIGS. 1 and 5; packaged separately, for example, in a multi-pack as illustrated in FIGS. 11A, 11B, 12A, 12B, 18E and 18F; or attached to a label as illustrated in FIG. 3.

The funnel may be disposable. In one embodiment of the invention, as illustrated in FIGS. 1 and 2A-2C, the funnel may be formed from a paper stock, such as 80 pound cover glass or coated stock, plastic, etc. and optionally formed with preformed folds to enable the funnel to be folded in quarters and attached to a container with a suitable adhesive, such as rubber cement or an adhesive commonly known as glue dots.

Figure 3:
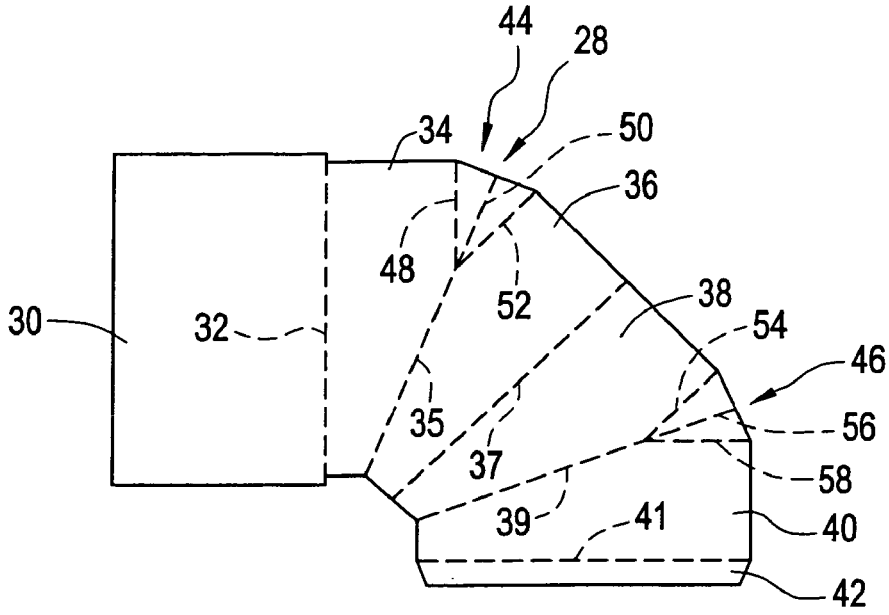
FIG. 3 is a view of yet another alternate embodiment of a collapsible funnel that is configured to be attached and formed as part of the label on a container.
Figure 4A:
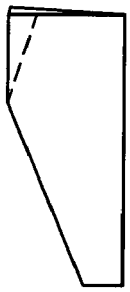
FIGS. 4A-4C illustrate a fully collapsed, intermediate and fully expanded configuration of the disposable funnel illustrated in FIG. 3.
Figure 4B:
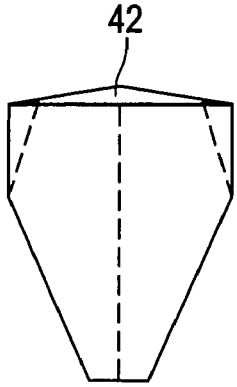
Figure 4C:
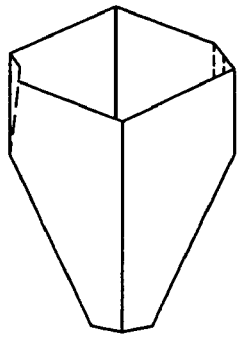
Figure 6A:
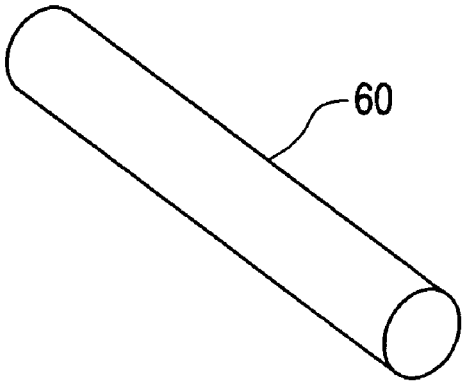
FIG. 6A is a perspective view of a disposable funnel shown in a rolled configuration.
Figure 6B:
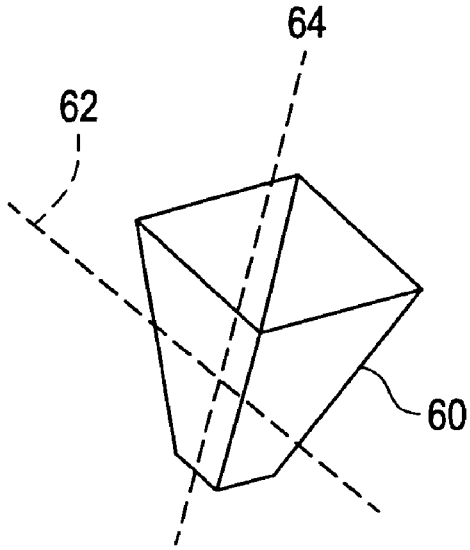
FIG. 6B is a perspective view of the funnel illustrated in FIG. 6A in a fully expanded configuration.

In an alternate embodiment as illustrated in FIG. 3, the disposable funnel is configured to be removably attached to a label. FIGS. 4A-4C illustrate an embodiment of the funnel which may be attached to a label by way of a perforation or alternatively attached to a container as shown in FIG. 1. FIGS. 5, 6A and 6B illustrate yet another embodiment of a disposable funnel which may be releasably attached to a container. In this embodiment, the disposable funnel may be folded or rolled along either its longitudinal or transverse axis into a tubular shape and releasably attached to the exterior of the container. All of the embodiments disclose a disposable funnel for use which may be integrated with a container in order to provide an individual disposable funnel for use with each container.

Various configurations of the collapsible funnel in accordance with the present invention are contemplated as shown in FIGS. 1, 7-20, 13-16 and 17-19. Turning to FIG. 1, a perspective view of a container with an integrated funnel is illustrated and generally identified with the reference numeral 20. The container 20 may be used for any fluid and may be formed from any material normally used for containers, such as plastic, glass or metal. As shown, the container 20 may be formed with a spout or dispensing port 22 and at least one flattened surface 24 for receiving a funnel 26 in a folded or compressed form. Alternatively, the container 20 may be formed without a flattened surface 24. In such an application, the funnel 26 may be attached to an arcuate surface in the same manner as a label is attached to arcuate surfaces of various containers. In either embodiment, the funnel 26 is in a flattened and compressed form and releasably attached to the container 20 to provide an individual disposable funnel 20 for each container 22. As such, the invention is well suited in applications for use with motor oil, transmission fluid and the like, normally sold in service stations, where such items are normally sold individually. In accordance with the present invention, each container is provided with a detachable disposable funnel to facilitate pouring of the fluid within the container.

Figure 2A:
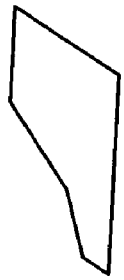
FIGS. 2A-2C illustrate the various stages of the funnel from a fully collapsed position as shown in FIG. 2A to a fully open position as shown in FIG. 2C.
Figure 2B:
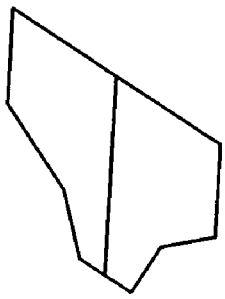
Figure 2C:
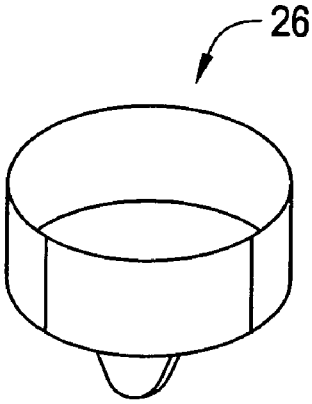

An exemplary funnel configuration is illustrated in FIGS. 2A-2C. As shown in FIG. 2A, the funnel 26 is shown in a fully collapsed form and folded in quarters. FIG. 2B illustrates an intermediate configuration of the funnel 26, shown folded in half. FIG. 2C illustrates a fully expanded funnel 26 for use with the fluid within the container 20.

FIG. 3 illustrates an alternate embodiment of the funnel 28 which may be releasably attached to a label 30, which, in turn, is secured to a container 32 or inserted into a printed publication. As shown in FIG. 3, the funnel 28 is formed from a piece of flat stock and releasably attached to a label 30, for example, by way of a perforation 32, formed, for example, by way of a die cut. In this embodiment, the funnel 28 is formed from a piece of flat stock in the shape, for example, as shown in FIG. 3 four panels 34, 36, 38 and 40 defined by four fold lines 35, 37, 39 and 41 and a glue tab 42. The funnel 28 may also be optionally formed with opposing tabs 44 and 46, formed from a plurality of fold lines 48, 50, 52, 54, 56 and 58. These tabs 44 and 46 may optionally be provided to prevent collapse of the funnel 28 after it is expanded to its final use configuration.

FIGS. 4A-4C illustrate the assembly of the flat stock forming the funnel 28 in accordance with this aspect of the invention. Initially, the flat stock 28 may be folded along the fold line 37 while at the same time securing the glue flap 42 to the panel 34 adjacent the perforation line 32. The funnel 28 may also be optionally folded along the fold lines 35 and 39 to form the flat quartered configuration illustrated in FIG. 4A. The funnel 28 can then be expanded as illustrated in FIG. 4B by separating the panels. Once the panels are separated, the tabs 44 and 46 may be squeezed together to minimize the possibility of collapse of the funnel 28 during use.

The flat stock mentioned above may also be used in an application when it is not attached to a label as illustrated in FIGS. 1 and 2A-2C. In this application, the flattened funnel 28 is preassembled into the flattened configuration as illustrated, for example, in FIG. 4A. The flattened funnel 28 is attached to the container 22 with a suitable adhesive. In this embodiment, the funnel 28 may be provided with or without the tabs 44 and 46.

Another of embodiment of the invention is illustrated in FIGS. 5, 6A and 6B. In this embodiment of the invention, a funnel 60 may be rolled or folded relative to a transverse axis 62 or a longitudinal axis 64 to form a generally tubular configuration as illustrated in FIG. 6A. This tubular configured funnel 60 may be attached to a container 66. The container 66 may be formed with an exterior cavity (not shown) either along the sides or underneath which conforms to the general shape of the tubular configuration of the funnel 60.

Process for Making a Collapsible Funnel

The collapsible funnel in accordance with the present invention can be made by various processes. An exemplary process for making the collapsible funnel is described below and illustrated in FIGS. 7-10 for four exemplary embodiments of the collapsible funnel in accordance with the present invention. It should be understood that the process described below may also be used to fabricate the collapsible funnels illustrated in FIGS. 1, 3, 6 and 14-16 as well as the collapsible funnels formed with header cards as illustrated in FIGS. 13, 17 and 18. Any one of these steps may or may not be used in this process and may be used in any order.

Step 1. Printing of Folding Funnel (Optional)

The paper stock to be used for the funnel blank may be printed in any desired configuration, using any traditional or nontraditional method. This step may include standard offset printing on a Komori or any similar machine. Perfecta machines, thermal transfer machines, silkscreen machines, digital or plateless machines or even stamping or embossing machines which embed an image on the material without using inks or any other machine and/or process which can achieve the same or similar result desired. In other words, any method of transferring a visible impression onto the material may be used. The printing can essentially be done at various steps in the process.

Step 2: Cutting

The stock, for example, paper stock, is die cut, for example, into a specific pattern as illustrated in FIGS. 7A, 8A, 9A and 10A, for example, forming a funnel blank. The die cutting may be done by a Zerand Web Cutter, for example.

Step 3. Scoring and Cutting

The funnel blank may optionally be scored, for example, a Zerand Web Cutter Creaser or any other machine and/or process which can achieve the same or similar desired results, for example, as illustrated in FIGS. 7B, 8B, 9B and 10B. The scoring is used to define fold lines which facilitate the assembly of a funnel blank into a funnel. In same embodiments, for example, as shown in FIGS. 14A and 14B, scoring may not be required.

Step 4. Folding and Gluing

The optionally scored and cut material can then be folded and, if desired, glued on a Bobst Flexo-Folder Gluer or any other machine and/or process which can achieve the same or similar result desired. The material does not have to be glued. Various adhesives are suitable, such as double-sided tape, glue strip, small tabs or any type of channel that can be used to manually hold together the ends of the cut material (FIGS. 7C-7E, 8C-8D, 9C-9E and 10C-10E.)

Secondary Process Steps

The collapsible funnel in accordance with the present invention can be used in various applications. Depending on the application, various secondary processing steps are required.

Option #1. Inserting the Folded Funnel

The folded funnel can be inserted into various secondary containers or dispensers using a Sitma C80/305 Polywrapper, Autobagger H-100 or Sencorp Automatic Heat Sealing Machine such as a Model HP 15-6E, and/or process that can achieve the same or similar result desired. This secondary container or dispenser can be of any type, from a small pouch holding one or more folded funnels to a large dispensing unit holding many folding funnels. Exemplary secondary containers are illustrated in FIGS. 11A, 11B, 12A and 12B.

Option #2. Applying the Folded Funnel

Figure 7A:
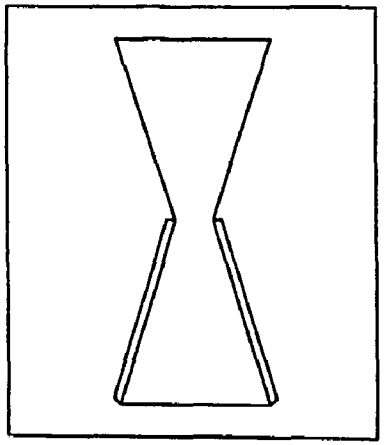
FIGS. 7A-7I are process diagrams that illustrate the step-by-step process for forming one embodiment of the invention.
Figure 7B:
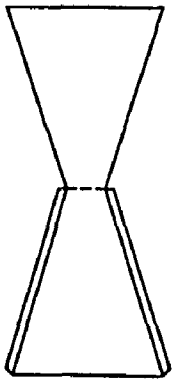
Figure 7C:
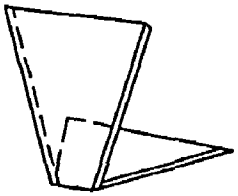
Figure 7D:
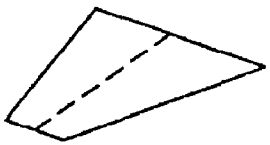
Figure 7E:
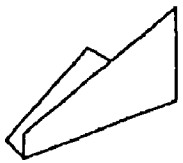
Figure 7F:
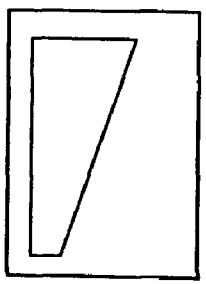
Figure 7G:
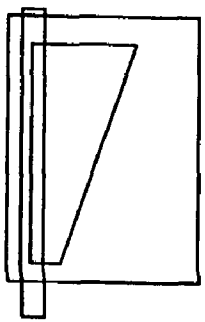
Figure 7H:
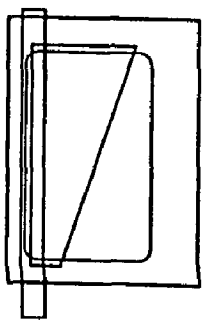
Figure 7I:
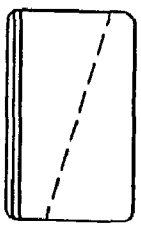
Figure 8A:
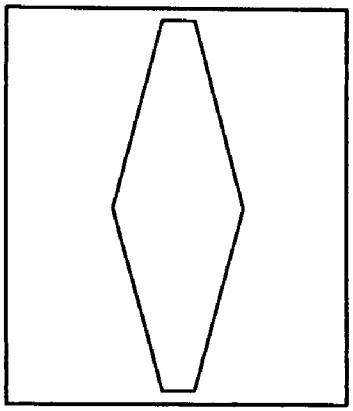
FIGS. 8A-8H are process diagrams that illustrate the step-by-step process for forming a an alternate embodiment of the invention.
Figure 8B:
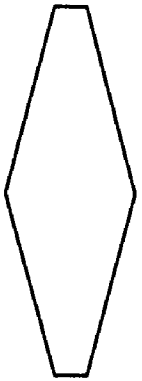
Figure 8C:
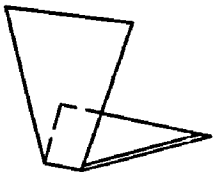
Figure 8D:
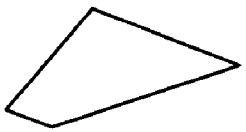
Figure 8E:
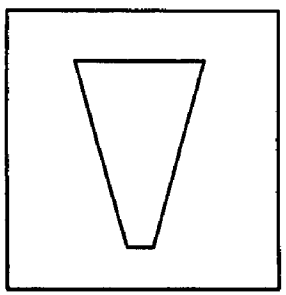
Figure 8F:
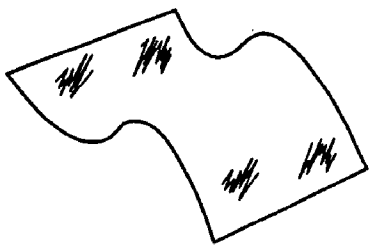
Figure 8G:
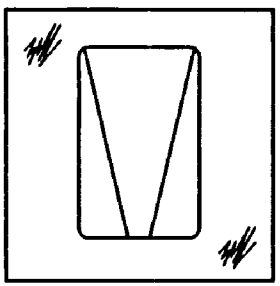
Figure 8H:
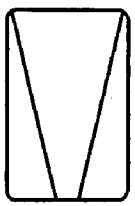
Figure 9A:
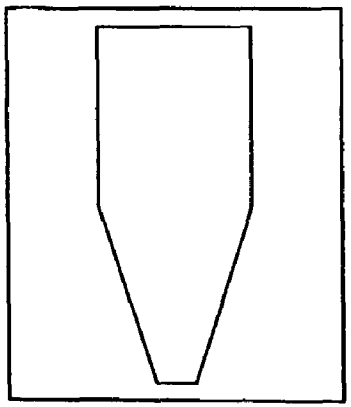
FIGS. 9A-9H are process diagrams that illustrate the step-by-step process for forming another alternate embodiment of the invention.
Figure 9B:
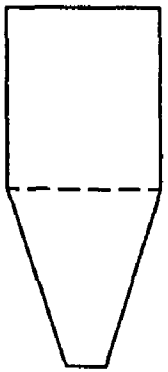
Figure 9C:
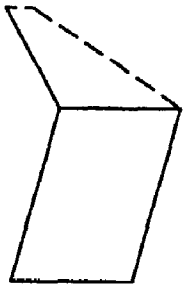
Figure 9D:
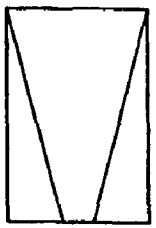
Figure 9E:
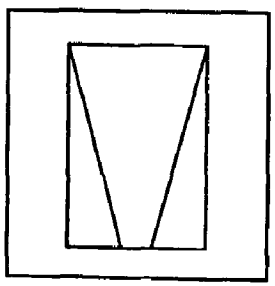
Figure 9F:
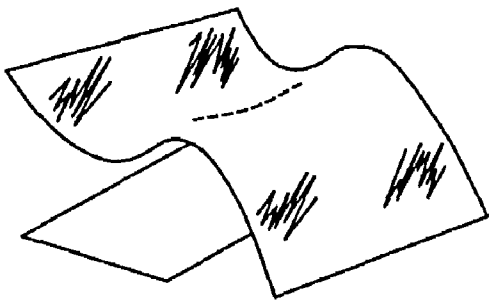
Figure 9G:
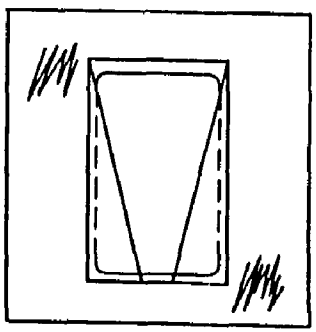
Figure 9H:
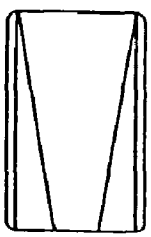
Figure 10A:
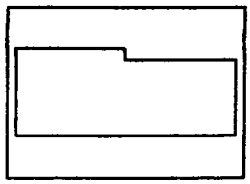
FIGS. 10A-10H are process diagrams that illustrate the step-by-step process for forming another embodiment of the invention.
Figure 10B:
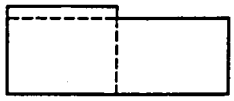
Figure 10C:
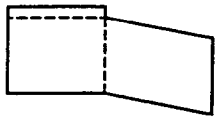
Figure 10D:
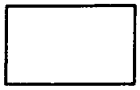
Figure 10E:
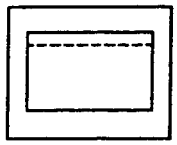
Figure 10F:
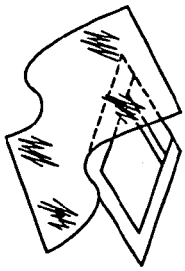
Figure 10G:
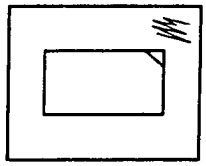
Figure 10H:
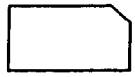

The funnel may be affixed to a cardboard, paper or pressure-sensitive-backing using a hot melt releasable adhesive. This is typical when using "stacker", "Pick 'n-Place" or any similar type of placing process. Furthermore the funnel may be placed over the cardboard, paper, or pressure-sensitive backing and then covered with adhesive film (or any similar material) or laminated in place on said backing (FIG. 7G, for example.) The funnel unit/label can then be die cut and perforated if desired on a Soft-Anvil Rotary Die Cutting System or any other machine and/or process which can achieve the same or similar result desired (FIG. 7I, for example.) This process is typical in the production of roll-fed labels. (FIGS. 7F-7I and 8E-8H)

Option #3. Applying the Scored/Folded Material or Folded Funnel to Pressure Sensitive Adhesive The funnel may be placed, affixed or overlapped on a pressure sensitive adhesive or any similar material. An adhesive film (any similar material) or laminate can then be applied over the combination of materials creating a one piece/unit (FIGS. 7F and 7G). The funnel unit/label can then be die cut and perforated if desired on a Soft-Anvil Rotary Die Cutting System or any other machine and/or process which can achieve the same or similar result desired (FIG. 7H). This process is typical in the production of roll-fed labels (FIGS. 7F-7H).

Collapsible Funnel with Header Cards

Header cards, for example, as generally identified with the reference numerals 70-82 (FIG. 13), can be integrally formed with the funnel. Various configurations of the header cards 70-82 are contemplated. For example, the header card 70 (FIG. 13A) may be used for hanging hook, peg board and any standard point of sale merchandise unit. The header card 72 (FIG. 13B) may be used in applications where the funnel is to be attached to a container top. The header card 74 (FIG. 13C) is similar to the header card 72 but allows for a tighter fit. The header card 76 (FIG. 13D) is formed as an elongated tab which allows it to be inserted into a slot. The header card 78 (FIG. 13E) may be custom configured and may be die cut to personalize corporate logos, events symbols or anything desired. The header 80 (FIG. 13F) consists of an attached string, where x or plastic tie for attachment. The header 82 (FIG. 13G) includes a combination of a header card and an attachment material, for example, an elastic material made from flexible rubber, plastic or other material which returns to it s original size after being stretched out.

Figure 17A:
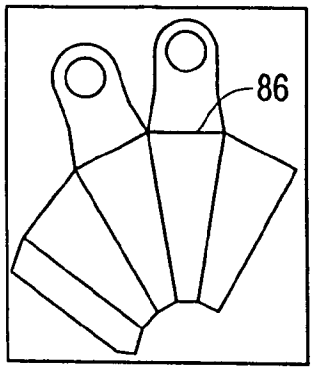
FIGS. 17A-17D illustrate a disposable blank shown with a one embodiment of a header card in accordance with the present invention.
Figure 17B:
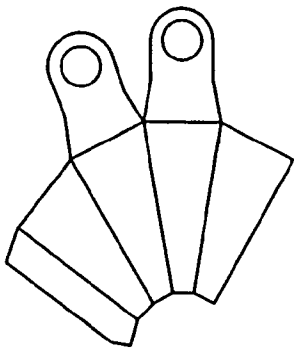
Figure 17C:
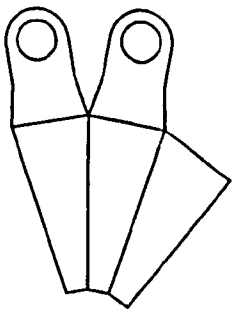
Figure 17D:
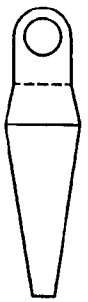
Figure 18A:
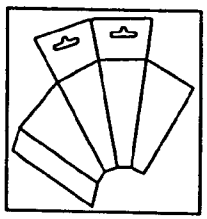
FIGS. 18A-18F illustrate an alternate embodiment of a funnel blank with an alternate header card.
Figure 18B:
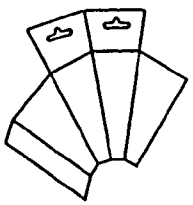
Figure 18C:
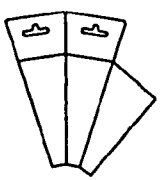
Figure 18D:
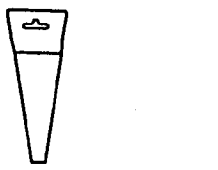
Figure 18E:
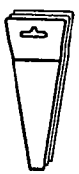
Figure 18F:
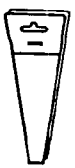
Figure 19:
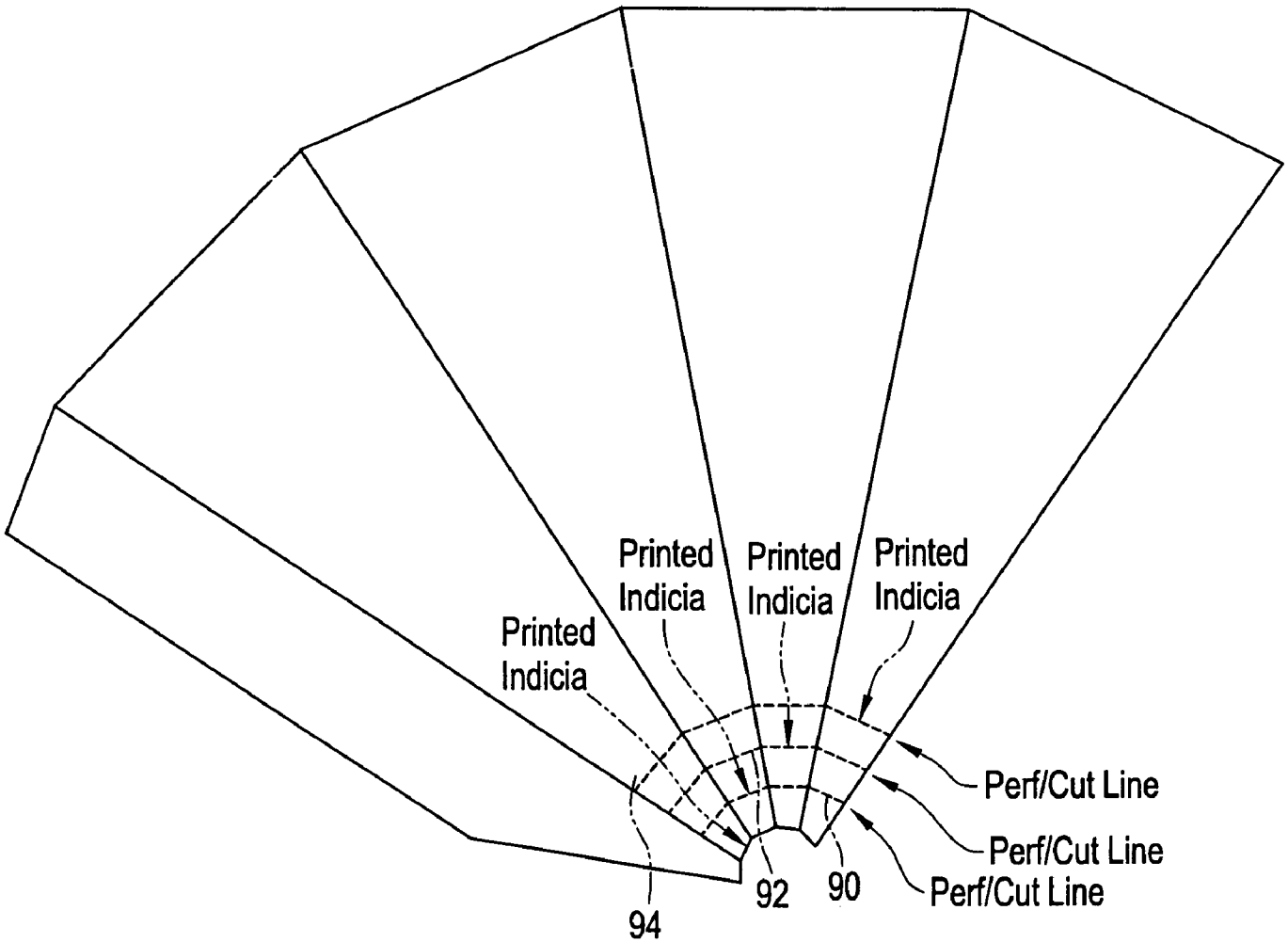
FIG. 19 illustrates an exemplary funnel with perforation marks and printed indicia-related to the perforation marks which enables the diameter of the funnel hole to be selected by the end user.

The process for making collapsible funnels with header cards is similar to the process described above with the exception that the funnel blank is die cut with the funnel and integral header card, for example, as illustrated in FIGS. 17A and 18B. As shown in FIGS. 17B-17D and 18B-18D, the collapsible funnels are fabricated using virtually the same steps. However, various options are available for the interface 86 (FIG. 17A) defined between the collapsible funnel and header card. For example, the interface may be a perforation, a fold line or neither. As shown in FIGS. 18E and 18F, the collapsed device can be combined with multiple similar devices in various configurations, such as stacking and attached together by various methods. For example, the funnels can be attached together by stapling, stitching, glue, heat attachment, tape, insertion into another container, for example, as illustrated in FIGS. 11 and 12, or alternately by riveting or posts. In addition, a single header card can be made to hold multiple devices.

Collapsible Funnel with Selectable Spout Size

FIG. 19 illustrates an aspect of the invention in which the funnel fluid outlet opening size is selectable. In this embodiment, perforations 90, 92 and 94 may be formed adjacent an outlet end of the funnel blank. The location of the perforations 90, 92 and 94 are selected to allow the fluid outlet opening size of the funnel to be selected. Originally, the funnel blank may optionally be formed with a fluid inlet opening and a first fluid outlet opening. Tearing along the perforations 90, 92 and 94 will result in relatively larger fluid outlet openings. Indicia may optionally be printed adjacent each of the perforation lines 90, 92, and 94 to indicate the size or use (i.e. motor oil, transmission fluid) of each fluid outlet opening size. In lieu of perforating, the perforation lines may simply be printed on the funnel blank. By providing selectable fluid outlet sizes, one funnel configuration can be used in multiple applications.

Business Method

The flat funnel blanks as illustrated in FIGS. 2, 3, 7-10 and 17-19 may be used in other applications prior to assembly. For example, the funnel blanks may be used as a substrate for printed indicia and used as a printed publication or incorporated into a printed publication, such as a sports program, catalog or advertisement. For example, a funnel blank may be used at a NASCAR race as a racing program. In this embodiment, the funnel blank can be used either still attached to the sheet of stock shown in FIGS. 7A, 8A, 9A and 10A or detached from the paper stock as shown in FIGS. 7B, 8B, 9B and 10B.

Obviously, many modification and variations of the present invention are possible in light of the above teachings. For example, thus, it is to be understood that, within the scope of the appended claims, the invention may be practiced otherwise than as specifically described above.

We claim:

1. A collapsible funnel comprising:

a funnel blank formed from a flat piece of stock having a thickness defining a funnel portion having at least three (3) fold lines and a header card portion defining an interface there between, said funnel portion defining opposing edges and forming a collapsed funnel when said opposing edges are joined together, said collapsed funnel configured to be folded along said at least three (3) fold lines forming a funnel at least four thickness thick and adapted to be expanded to a use position defining a fluid inlet opening and a fluid outlet opening; and an adhesive for attaching said opposing edges together.

2. The collapsible funnel as recited in claim 1, wherein said interface is a fold lines.

3. The collapsible funnels as recited in claim 1, wherein said interface is a perforation.

4. The collapsible funnel as recited in claim 1, wherein said header card portion is removably attached to said funnel portion.

5. A collapsible funnel, comprising:

a funnel blank formed from a flat piece of stock defining a funnel portion and a header card portion defining an interface there between, said funnel portion defining opposing edges; and forming a collapsed funnel when said opposing edges are joined together , said collapsed funnel adapted to be expanded to an expanded position defining a fluid inlet opening and a fluid outlet opening; and an adhesive for attaching said opposing edges together, wherein said collapsible funnel includes one or more indications adjacent said fluid outlet opening indicative of different fluid outlet opening sizes.

6. The collapsible funnel as recited in claim 5, wherein said collapsible funnel includes one or more perforations adjacent said indications.

7. The collapsible funnel as recited in claim 1, wherein said header card includes an aperture.

8. The collapsible funnel as recited in claim 7, wherein said aperture is configured to enable said collapsible funnel to be hung on a hook.

9. A collapsible funnel, comprising:

a funnel blank formed from a flat piece of stock having a thickness defining a funnel portion having at least three (3) fold lines and a header card portion defining an interface there between, said funnel portion defining opposing edges and forming a collapsed funnel when said opposing edges are joined together, said collapsed funnel configured to be folded along said at least three (3) fold lines forming a funnel at least four thickness thick and adapted to be expanded to an expanded position defining a fluid inlet opening and a fluid outlet opening; and an adhesive for attaching said opposing edges together, wherein said aperture is configured to enable said collapsible funnel to receive a container top.

10. The collapsible funnel as recited in claim 1, wherein said interface portion consists of a tie.

11. The collapsible funnel as recited in claim 1, wherein said interface portion is a label.

12. The collapsible funnel blank as recited in claim 1, wherein said interface portion is formed as a tab.

* * * * *